United States Patent [19]

Nogi et al.

[11] Patent Number: 4,641,671

[45] Date of Patent: Feb. 10, 1987

[54] AUTOMATIC DISHWASHER

[75] Inventors: Munehiro Nogi; Ryutaro Ohashi; Koichiro Miyazaki, all of Sakai; Takashi Tanaka, Osaka; Koichiro Tamakoshi, Sakai; Yoshiziro Tamano, Kusatsu; Syotaro Wakita, Wakayama; Toshimitsu Suzuki, Kishiwada, all of Japan

[73] Assignee: Daikin Industries Ltd., Osaka, Japan

[21] Appl. No.: 702,795

[22] Filed: Feb. 19, 1985

[30] Foreign Application Priority Data

Feb. 20, 1984 [JP] Japan ..... 59-31088
Feb. 20, 1984 [JP] Japan ..... 59-23697 [U]
May 17, 1984 [JP] Japan ..... 59-72822 [U]
Dec. 28, 1984 [JP] Japan ..... 59-201276 [U]

[51] Int. Cl.[4] ..... B08B 3/02

[52] U.S. Cl. ..... 134/57 D; 134/95; 134/98; 134/103; 134/113

[58] Field of Search ..... 134/56 D, 57 D, 95, 134/98, 103, 113, 58 D

[56] References Cited

U.S. PATENT DOCUMENTS 1,323,216 11/1919 Cornwall et al. ..... 134/57 D
1,447,305 3/1923 Hauk ..... 134/98
1,458,028 6/1923 Burnham ..... 134/113 X
1,941,660 1/1934 Collins ..... 134/58 D
3,083,717 4/1963 Bear .
3,279,481 10/1966 Sones .
4,277,290 7/1981 Andrews et al. ..... 134/95 X

FOREIGN PATENT DOCUMENTS 497149 5/1930 Fed. Rep. of Germany ..... 134/98
2441361 11/1976 Fed. Rep. of Germany ..... 134/95
1384930 11/1964 France .
2305159 3/1975 France .
474758 11/1937 United Kingdom ..... 134/98

*Primary Examiner*—Philip R. Coe
*Attorney, Agent, or Firm*—Birch, Stewart, Kolasch & Birch

[57] ABSTRACT

An automatic dishwasher which comprises an enclosure for accommodating articles to be washed, a washing solution tank arranged below the enclosure, a hot water storage tank for containing a predetermined amount of hot water for rinsing use, a plurality of nozzles for spraying a liquid medium towards the articles in the enclosure, a motor-driven pump, a first piping connecting a discharge port of the pump with the nozzles, a second piping connecting both of the solution and storage tanks with a suction port of the pump, and a valve assembly disposed on the second piping and operable to close a first passage between the suction port and the storage tank and to open a second passage between the suction port and the solution tank during the washing operation in which the articles are washed, and to open and close the first and second passages, respectively, during the rinsing operation in which the articles are rinsed.

8 Claims, 16 Drawing Figures

| | Initial Hot Water Supply | WASH | RINSE | | WASH | RINSE | WA |
|---|---|---|---|---|---|---|---|
| 37 | | | | | | | |
| 31 | | | | | | | |
| 100 | | | | | | | |
| 101 | | | | | | | |
| 36 | | | | | | | |

Supply to Tanks 12&13.

Supply to Tank 13.

AUTOMATIC DISHWASHER

BACKGROUND OF THE INVENTION

The present invention relates to an automatic dishwasher for sequentially washing and rinsing dishes or other articles to be washed.

Currently commercially available automatic dishwashers are generally classified into two types, i.e., tank system and fresh water supply system, depending on the piping system used therein.

An example of the prior art dishwashers of tank system is disclosed in, for example, the Japanese Laid-open Patent Publication No. 57-139315, published Aug. 28, 1982, and is schematically shown in FIG. 1 of the accompanying drawings. As shown in FIG. 1, the prior art dishwasher with a tank system is so designed that, after a washing solution (containing a detergent) within a solution tank T has been pumped by a circulating pump P1 towards spray nozzle assemblies N1 and then sprayed onto articles supported in a rack R to wash the articles, the sprayed washing solution is recovered in the solution tank T for recirculation towards the nozzle assemblies N1 through the circulating pump P1, thereby bringing the washing action on the articles. After the washing operation, a fresh rinsing water supplied through a supply pipe L1 into a booster (heating device) B and heated therein is supplied under pressure towards spray nozzle assemblies N2 through a water supply pipe L2, which is separate from the supply pipe for the flow of the washing solution, and then sprayed onto the articles in the rack R to rinse the articles. The washing solution remaining in the tank T is allowed to overflow into an overflow tube OT for discharging a quantity of washing solution required to accomodate the sprayed rinsing water in the tank T.

In this prior art dishwasher shown in FIG. 1, as a source of pressure necessary to supply the rinsing water from the booster B towards the nozzle assemblies N2, either the pressure of water supplied from a water main to the dishwasher, or a pump such as shown by P2 which is separate from the circulating pump P1, is employed.

Thus, the prior art dishwasher shown in FIG. 1 requires the use of two separate pumps for the washing and rinsing operations, respectively, resulting in increased manufacturing cost. In a prior art dishwasher in which from a water main is employed for supplying the rinsing water while only one pump is used for the washing operation, the rinsing efficiency tends to be adversely affected by fluctuating water main pressure and, therefore, an extra pressure control device for regulating the water pressure to a predetermined value is required, thereby resulting not only in greater complexity of the dishwasher as a whole but also increased manufacturing cost.

Moreover, since the two separate pipe lines are used for the supply of the washing solution and the rinsing water, not only is the number of the component parts used increased with the consequence of the correspondingly increased manufacturing cost, but also time-consuming and complicated procedures are required to clean the dishwasher, particularly the piping system including the separate pipe lines and the nozzle assemblies.

On the other hand, an example of prior art dishwashers of fresh water supply system is disclosed in, for example, the U.S. Pat. No. 3,465,762, patented Sept. 9, 1969, and is schematically shown in FIG. 2 of the accompanying drawings. The prior art dishwasher shown in FIG. 2 is so designed that, after the washing solution within the solution tank T has been pumped by a pump P towards a spray nozzle assembly N and then sprayed onto the articles supported in the rack R to wash the articles, the sprayed washing solution is recovered in the tank T for recirculaton towards the nozzle assembly N, thereby applying a washing action to the articles. After the completion of the washing operation, an electromagnetic valve EV disposed on a drain pipe DP is opened to drain the total quantity of washing solution within the tank T, whereupon a hot water is introduced through a hot water supply line La into the tank T. When the amount of the hot water so introduced attains a predetermined level within the tank T, the pump P is again operated to apply a rinsing action to the articles.

Although the dishwasher with a fresh water supply system is advantageous in that only one pump can be utilized for both washing and rinsing operations, food solids removed from the articles having been washed into the tank T are apt to be mixed with the rinsing water, reducing the rinsing efficiency. In addition thereto, a relatively long time including the time required to drain the washing solution and the time required to supply the rinsing water tends to be consumed subsequent to the completion of the washing operation and before the start of the rinsing operation, and moreover, the total amount of the water within the tank has to be drained each time any one of the washing and rinsing operations has been completed. Accordingly, the prior art dishwasher of the type shown in FIG. 2 has an additional disadvantage in that a relatively large amount of water is consumed with increased running cost required.

SUMMARY OF THE INVENTION

Accordingly, the present invention has been developed for substantially eliminating the above discussed drawbacks inherent in the prior art dishwashers of any of the above mentioned systems and for providing an improved dishwasher taking advantage of the merits of both of the systems of prior art dishwashers.

Another important object of the present invention is to provide an improved dishwasher of the type referred to above, which is simple in structure, consumes a minimized amount of water, requires a minimized running cost and is effective to efficiently wash and rinse the articles in a reduced time.

A further object of the present invention is to provide an improved dishwasher of the type referred to above, wherein there is no possibility of food solids, removed from the articles washed, mixing with the rinsing water during the rinsing operation.

In order to accomplish these objects of the present invention, an improved dishwasher embodying the present invention comprises an enclosure for accommodating articles to be washed, a washing solution tank arranged below the enclosure, a hot water storage tank for containing a predetermined amount of hot water for rinsing use, a plurality of nozzles for spraying a liquid medium towards the articles in the enclosure, a motor-driven pump, a first piping connecting a discharge port of the pump with the nozzles, a second piping connecting both of the solution and storage tanks with a suction port of the pump, and a valve assembly disposed on the second piping and operable to close a first passage between the suction port and the storage tank, but to open a second passage between the suction port and the solution tank during the washing operation in which the articles are washed, and to open and close the first and second passages, respectively, during the subsequent rinsing operation in which the articles are rinsed. Thus, it is clear that, in the dishwasher embodying the present invention, only the circulating pump is employed for the circulation of the washing solution and the rinsing water at a time. This advantage is the outcome of the employment of the valve assembly of a unique construction herein disclosed.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

These and other objects and features of the present invention will become clear from the subsequent description of some preferred embodiments made with reference to the accompanying drawings, in which.

DETAILED DESCRIPTION OF PREFERRED EMBODIMENTS

Figure 1:
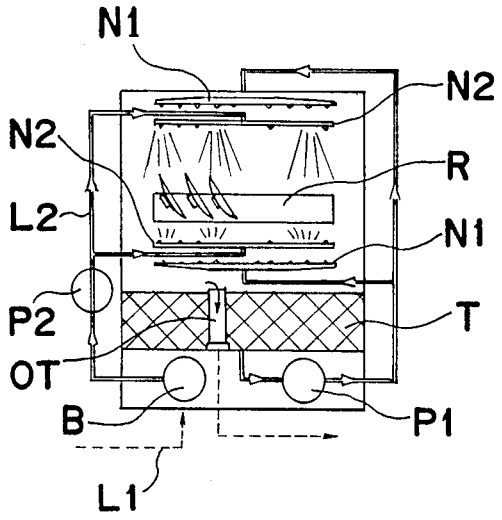
Fig. 1 Prior Art
FIGS. 1 and 2 are schematic diagrams showing the prior art dishwashers of different systems, respectively.
Figure 2:
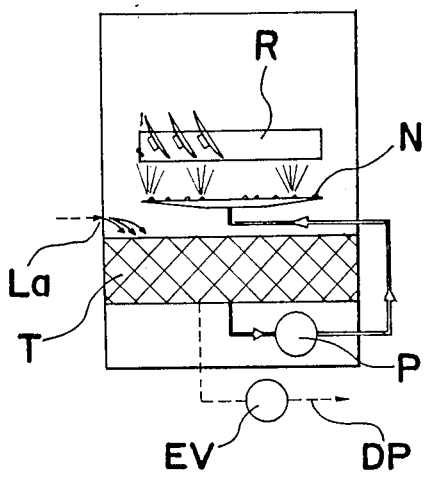
Fig. 2 Prior Art

Before the description of the present invention proceeds, it is to be noted that like parts are designated by like reference numerals throughout the accompanying drawings except for FIGS. 1 and 2.

Figure 3:
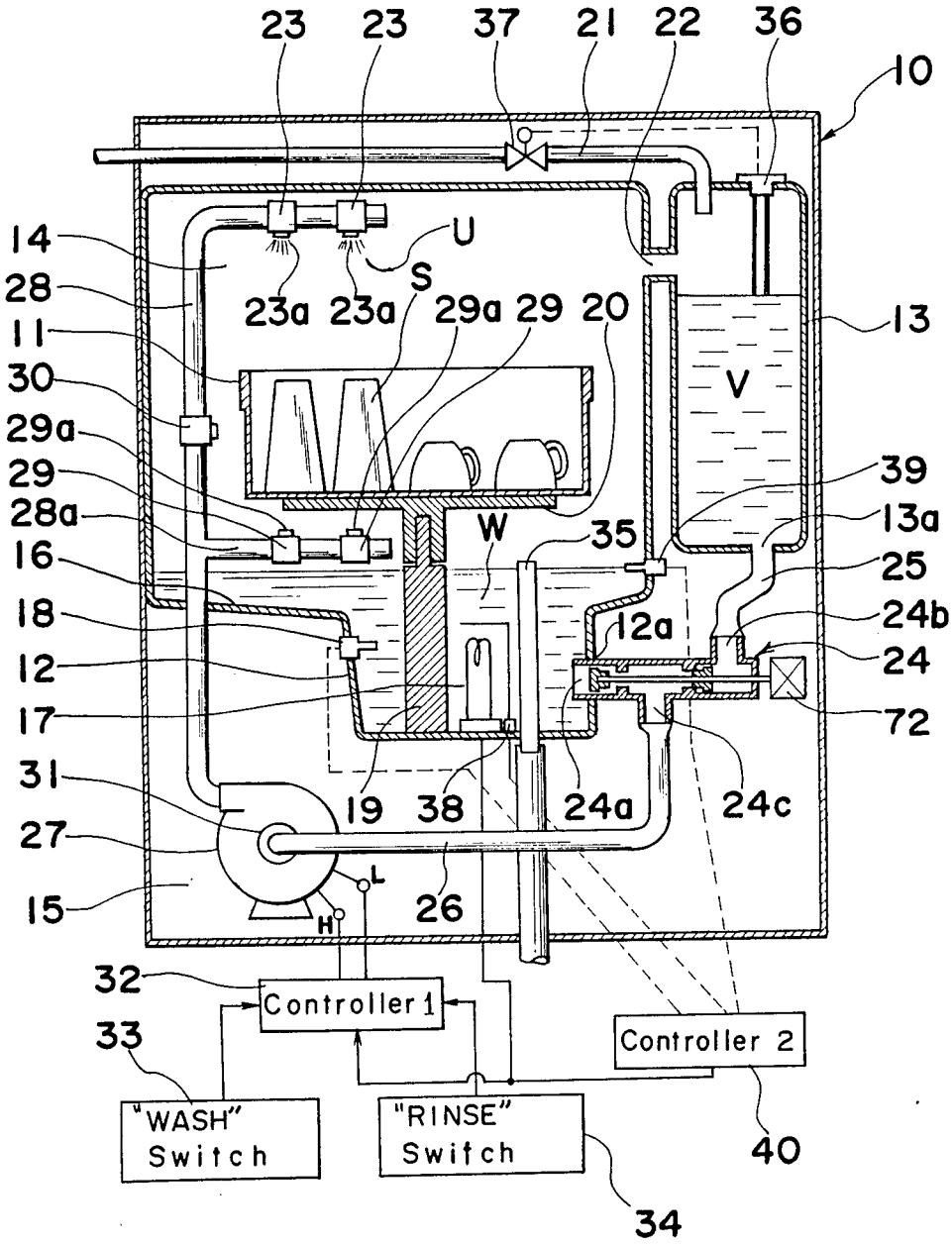
FIG. 3 is a longitudinal sectional view of a dishwasher according to first preferred embodiment of the present invention.

Referring to FIGS. 3 to 6, and particularly to FIG. 3, an automatic dishwasher shown therein comprises a cabinet 10 accommodating therein a support rack 11 for the support of dishes or other articles to be washed. A washing solution tank 12 positioned below the support rack 11, and a hot water storage tank 13 is positioned laterally of the washing solution tank 12. The cabinet 10 defines a washing chamber 14 and a pump chamber 15 at upper and lower regions thereof, respectively, which are partitioned by a bottom wall 16 having a centrally depressed portion forming the washing solution tank 12. The solution tank 12 accommodates therein a heater 17 and a temperature detector 18 for detecting the temperature of a washing solution W contained in the solution tank 12. The washing solution W within the solution tank 12 is used for washing the dishes or other articles S to be washed which are supported by the supported rack 11.

The support rack 11 is in the form of a generally cylindrical, perforated or mesh container and is placed on a turntable 20 rotatably mounted on an upright post 19 and positioned above the top level of the washing solution W within the solution tank 12, the upright post 19 extending upwardly from the bottom of the solution tank 12.

The hot water storage tank 13 positioned laterally of the solution tank 12 contains therein a predetermined amount of water V to be used for rinsing the articles S to be washed. The rinsing water V can be supplied into the tank 13 through a supply pipe 21 communicated therewith at the top of the tank 13. The rinsing water V within the tank 13 when exceeding the predetermined amount can overflow into the solution tank 12 through an overflow passage 22 so designed and so positioned as to avoid any possible leak into the tank 13 of water U sprayed from nozzles 23 and 29 situated within the washing chamber 14.

There is employed an electromagnetically operated three-way valve assembly 24 having a solution intake port **24*a* located within opening 12*a* defined in the wall of the tank 12, a water intake port 24*b* fluid-connected through a pipe 25 with a supply opening 13*a* defined in the bottom of the water tank 13 and an outlet port 24*c* fluid-connected through a pipe 26 with a suction port of a circulating pump 27 installed in the pump chamber 15. The three-way valve assembly 24 is attached directly to the solution tank 12 with its solution intake port 24*a* opening into the tank 12 so as to minimize the number of areas to be fluid-tightly sealed and also as to minimize any possible intrusion of food solids, removed from the articles S, into the three-way valve assembly. The pump 27 has its discharge port fluid-connected with a supply pipe 28 extending upwardly through bottom wall 16 and then bent horizontally so as to extend above the support rack 11 with its free end portion having the nozzles 23 mounted thereon. Each of the nozzles 23 has a plurality of nozzle openings 23*a* from which either the washing solution or the rinsing water, pumped by the pump 27 in a manner as will be described later, can be sprayed downwardly and over the articles S in the support rack 11. The supply pipe 28** has a branch pipe 28*a* branched off from a substantially intermediate portion thereof so as to horizontally extend between the turntable 20 and the top level of the washing solution W. A plurality of nozzles 29 each having a plurality of nozzle openings 29*a* are spacedly mounted on the branch pipe 28*a* so as to direct the liquid upwardly towards the articles S in the support rack 11 placed on the turntable 20. Also, a portion of the supply pipe 28 on the downstream side of the branch pipe 28*a* with respect to the direction of supply of the liquid towards the nozzles 23 and laterally of the support rack 11 is provided with a jet nozzle 30 for jetting the liquid (i.e., either the washing solution or the rinsing water) in a direction tangential to the circle occupied by the cross-sectional shape of the support rack 11 for driving the support rack 11 so as to rotate in one direction about the upright port 19 together with the turntable 20 during any one of the washing and rinsing periods as will be described later.

The circulating pump 27 is drivingly coupled with and, hence, driven by a variable-speed electric motor 31 having high speed and low speed terminals H and L electrically connected to a speed controller 32 capable of generating different signals one at a time to the terminals H and L, respectively. Specifically, the controller 32 can generate a signal to the terminal H to drive the pump 27 at a high speed in response the closure of a "WASH" switch 33 which will take place during the washing period, and a signal to the terminal L to drive the pump 27 at a low speed in response to the closure of a "RINSE" switch 34 which will take place during the rinsing period. As will be described later, the pump 27 can be driven by the motor 31 at a low speed during the hot water supply.

Reference numeral 35 represents an overflow pipe capable of permitting the discharge of the washing solution W when the amount of the solution W within the tank 12 exceeds a predetermined value. Reference numeral 36 represents a level detector of electrode type used for detecting the amount of hot water within the tank 13. Reference numeral 37 represents a shut-off valve disposed on the pipe 21 and operatively associated with the level detector 36 for interrupting the supply of the hot water to the tank 13 when the amount of the hot water V within the tank 13 exceeds a predetermined value.

It is to be noted that the solution tank 12 is provided with, in addition to temperature detector 18 for use in the adjustment of the temperature of the washing solution, an overheating preventive temperature detector 38 and a level detector 39 for detecting the position of the surface level of the washing solution W within the tank 13. These detectors 18, 38 and 39 are electrically connected with a second controller 40 which is in turn connected with the controller 32.

The operation of the dishwasher according to the embodiment shown in FIG. 3 will now be described with reference to FIGS. 4 and 5 in combination with FIG. 3.

Figure 4:
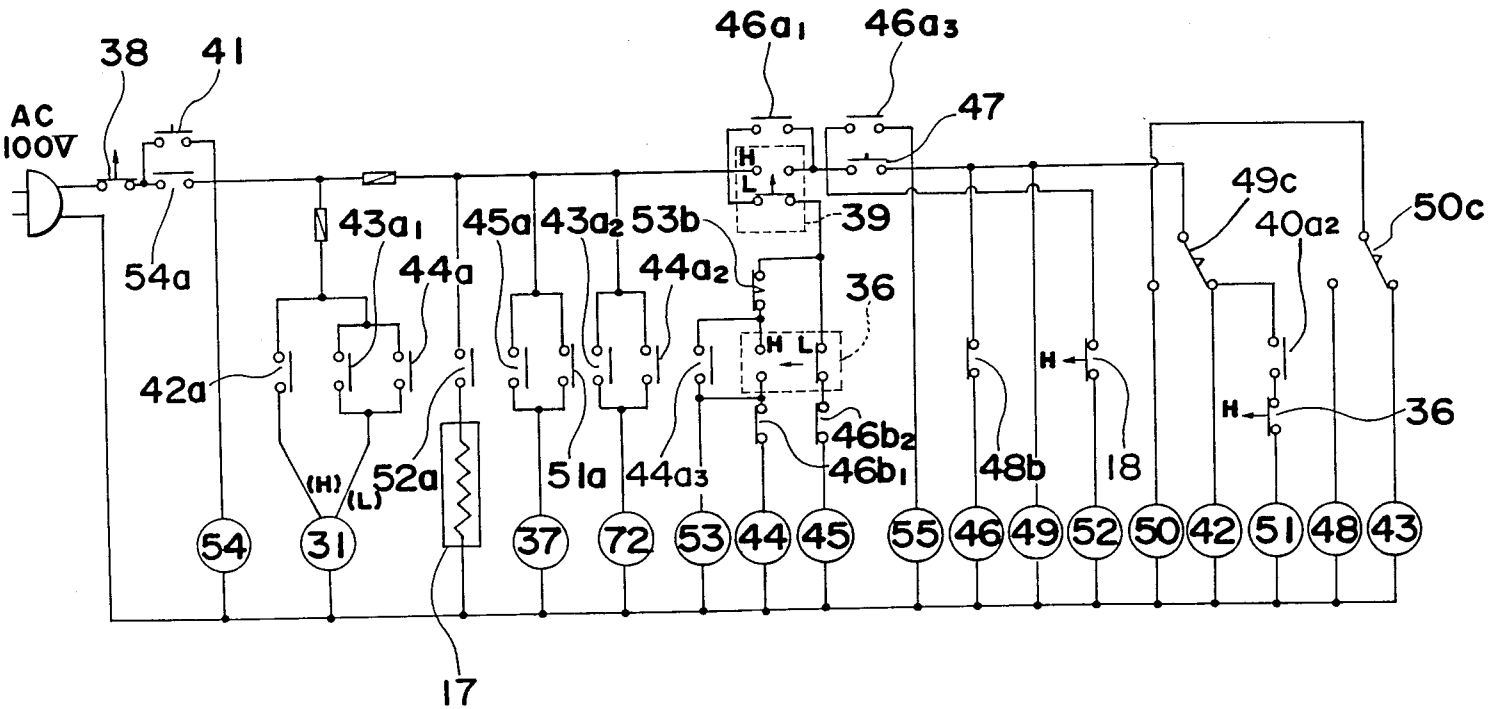
FIG. 4 is a diagram showing an electric control circuit employed in the dishwasher shown in FIG. 3.

Assuming that both of the tanks 12 and 13 are empty, the supply of hot water into hot water storge tank 13 can be effected simultaneously with the depression of a power source button 41 used in a circuit of FIG. 4. Electromagnetic valve 37 will open and remain open until the level detector 36 detects that the tank 13 has been filled with the predetermined amount of the hot water V.

The solution tank 12 can be filled to the level aligned with the level detector 39 by supplying the hot water, filled in the hot water storage tank 13, by means of pump 27.

After the washing liquid (detergent solution) has been added to the solution tank 12, the pump 27 is driven to start the washing period of the cycle of operation of the dishwasher. During this washing period, electromagnetic valve 37 is opened simultaneously with the start of the washing period to supply hot water into the hot water storage tank 13, and the closure of the electromagnetic valve 37 is effected in the same way as hereinbefore described. At this time, the three-way valve assembly 24 has not yet been energized, in which condition the solution tank 12 and the suction port of the pump 27 are in fluid-communication with each other.

During the washing of the articles S, the intake ports 24*a* and 24*b* of the valve assembly 24 are opened and closed, respectively, and the pump 27 is driven at the high speed. Therefore, the washing solution W within the solution tank 12 is pumped by the pump 27 to the supply pipe 28 and also to the branch pipe 28*a*. Consequently, not only can the washing solution be sprayed downwardly and upwardly from the upper nozzles 23 and the lower nozzles 29 to wash the articles S, respectively, but also the same washing solution can be jetted from the jet nozzle 30 towards the support rock 11 in a direction tangentially thereof to rotate the rack 11 together with the turntable 20. The washing solution sprayed and jetted in the manner as hereinabove described is collected in the solution tank 12 and then recirculated for washing the articles S. Since the amount of the washing solution sprayed is large because of the high speed drive of the pump 27, the articles S can be washed with high washing efficiency.

On the contrary thereto, during the rinsing period of the cycle of operation of the dishwasher, the intake ports 24*a* and 24*b* of the valve assembly 24 are closed and opened, respectively, and the pump 27 is driven at the low speed. This rinsing period ends at the time the total amount of the hot water within the hot water storage tank 13 is substantially consumed. Therefore, the hot water pumped from the hot water storage tank 13 is sprayed and jetted towards the articles S, in a manner similar to that during the washing period, to rinse the articles S while the rack 11 is rotated, and is then discharged to the outside through the pipe 35. At this time, since the amount of the rinsing water sprayed from the nozzles 23 and 29 is, because of the low speed drive of the pump 27, smaller than that of the washing solution sprayed from the same nozzles during the washing period, and is adjusted to an appropriate value, the rinsing of the articles S can be economically performed.

FIG. 4 illustrates the electric circuit necessary to cause the dishwasher to undergo the sequence of operation except for the initial switch manipulation. The operational cycle of the dishwasher is shown in FIG. 5. In FIG. 4, it will readily be seen that the drive motor 31 for the pump 27 can drive the pump at the high speed H when a relay 42 for the washing operation is energized. Pump 27 can be driven at low speed L when either relay 43 for the rinsing operation or relay 44 for the initial hot water supply is energized. Reference numeral 72 represents a solenoid of the electromagnetic three-way valve assembly 24 which, only when either relay 43 or 44 is energized, is energized to complete a fluid circuit between hot water storge tank 13 and pump 27 through the three-way valve assembly 24. It should be noted that, so long as solenoid 72 is not energized, the three-way valve assembly 24 is in a condition to establish a fluid circuit between the solution tank 12 and the pump 27 through the three-way valve assembly 24.

A relay 45 for the hot water supply can be energized so long as, while the level detector 39 detects a low level condition of the solution tank 12, the level detector 36 for the hot water storage tank 13 is inopertive (i.e., the amount of the water within the tank 13 is short of the predetermined amount).

Reference numeral 46 represents a relay for holding the operation. This relay 46 can be energized during a period starting from the depression of push button 37, which is effected while the level detector 39 for the solution tank 12 has detected the full level condition of the solution tank 12, until a relay 48 for the termination is energized, thereby to cause the dishwasher to perform a series of washing and rinsing operations.

Reference numeral 49 represents a timer of on-delay and off-reset type for the washing operation. This timer 49 can be energized simultaneously with the energization of the relay 46 and can cause an output contact **49*c*** to be changed over when a preset time during which the washing operation is performed is passed, and can hold it until the deenergization.

Reference numeral 50 represents a timer of on-delay and off-reset type for the rinsing operation. This timer 50 can be energized when the output contact **49*c* of the timer 49 is changed over at the time the preset time has been passed and can be kept energized until the relay 46 is deenergized, it being, however, that when a preset time during which the rinsing operation is performed is passed during the energization of the timer 50, an output contact 50*c*** can be changed over and can hold it until the deenergization.

The relay 42 for the washing operation can be energized during the passage of a predetermined time starting from the energization of the timer 49 until the change-over of the output contact **49*c***.

A relay 51 for the automatic hot water supply can be energized during the washing operation with the relay 42 energized and, at the same time, during the inoperative condition of the level detector 36.

The relay 48 for interruption can be energized when the output contact **50*c* is changed over after the lapse of a preset time subsequent to the energization of the timer 50*c*, and can be kept energized only for a short time before the deenergization of the relay 46**.

The relay 43 for the rinsing operation can be energized for a predetermined time subsequent to the timer 50 and prior to the change-over of the output contact **50*c***.

Reference numeral 52 represents a relay for the heater for the solution tank 12; reference numeral 53 represents a timer for driving a pump for the initial hot water supply; reference numeral 54 represents a self-energizing relay for a power source button switch 41; and reference numeral 55 represents a display lamp for indicating the operation.

Figure 5:
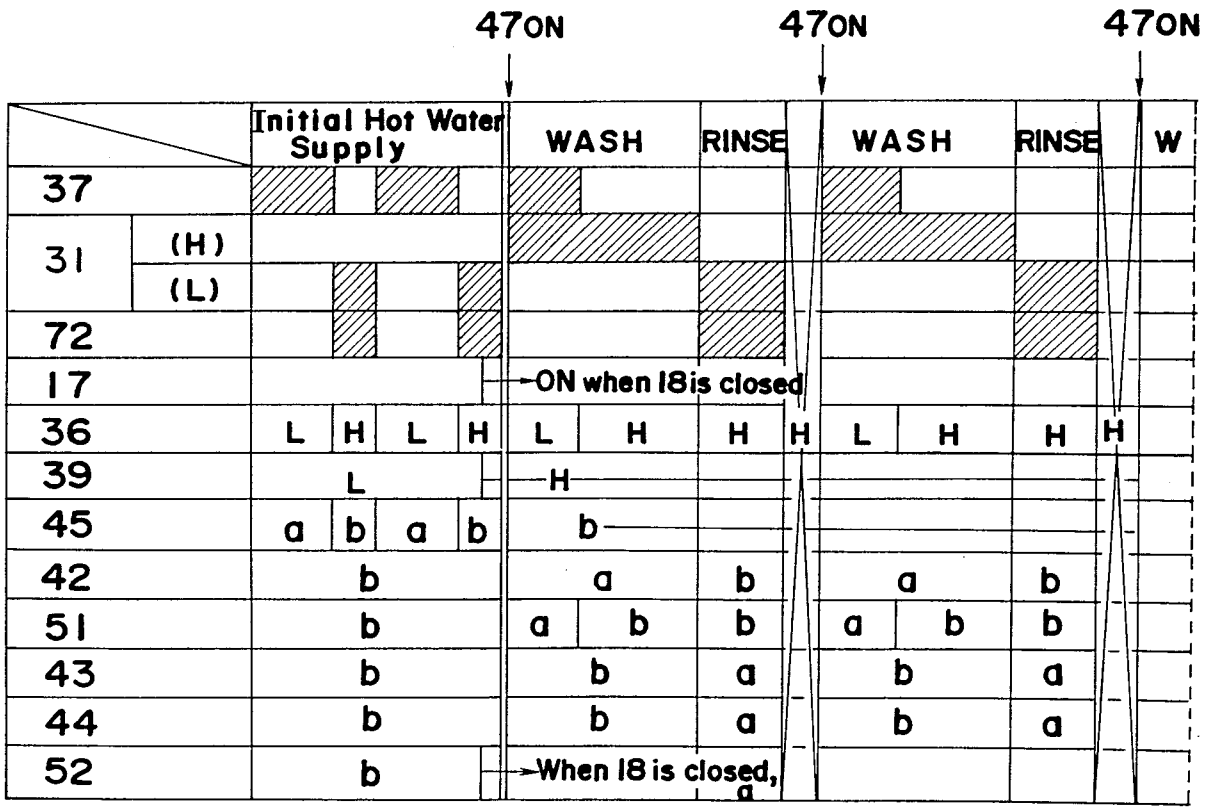
FIG. 5 is a timing chart showing the sequence of operation performed by the dishwasher shown in FIG. 3.

Referring now to FIG. 5, when the power source button 41 is manipulated, the level detector 39 detects "L" and the level detector 36 detects "L", whereby electromagnetic valve 37 is opened to permit the supply of hot water into hot water storage tank 13. The valve 37 is closed when the level detector 36 detects "H", and simultaneously therewith, the relay 44 for the hot water supply pump energizes the terminal L and the three-way valve assembly 24 to permit the supply of the hot water into the solution tank 12 for the preset time set by the timer 53. At this time, the pump is driven at a low speed. This is repeatedly performed until the level detector 39 detects "H". When the level detector 39 detects "H", and after the supply of the hot water which has taken place for the preset time set by the timer 53, the dishwasher is ready to perform its operation. It is however, to be noted that so long as the level detector 39 for the solution tank detects "L", the washing operation does not take place even if the start button 47 is manipulated.

When the start button 47 is subsequently manipulated, the pump 27 is driven at a high speed to effect the washing operation for the predetermined time set by the timer 49. Thereafter, the valve assembly 24 is energized, pump 27 is driven at a low speed, and the washing operation is switched over to the rinsing operation. The rinsing operation continues for the predetermined time set by the timer 50 and, thereafter, by the action of the relay 48, the pump 27 is brought to a halt and the valve assembly 24 is deenergized, thereby interrupting the operation of the dishwasher.

It is to be noted that, when the level detector 39 detects "H", the heater 17 in the solution tank 12 is operated by temperature sensor 18. Since the protective device 38 for avoiding any possible overheating is utilized, a power source reset condition can be established in the event of the occurrence of an abnormal condition.

By this single cycle of operation, the hot water contained in the tank 13 has been consumed with the tank 13 empty. Accordingly, simultaneously with the start of the washing operation for the next succeeding cycle, the relay 51 for the automatic hot water supply is energized to effect the supply of hot water into the tank 13 until the washing operation is completed, in readiness for the subsequent rinsing operation.

Figure 6:
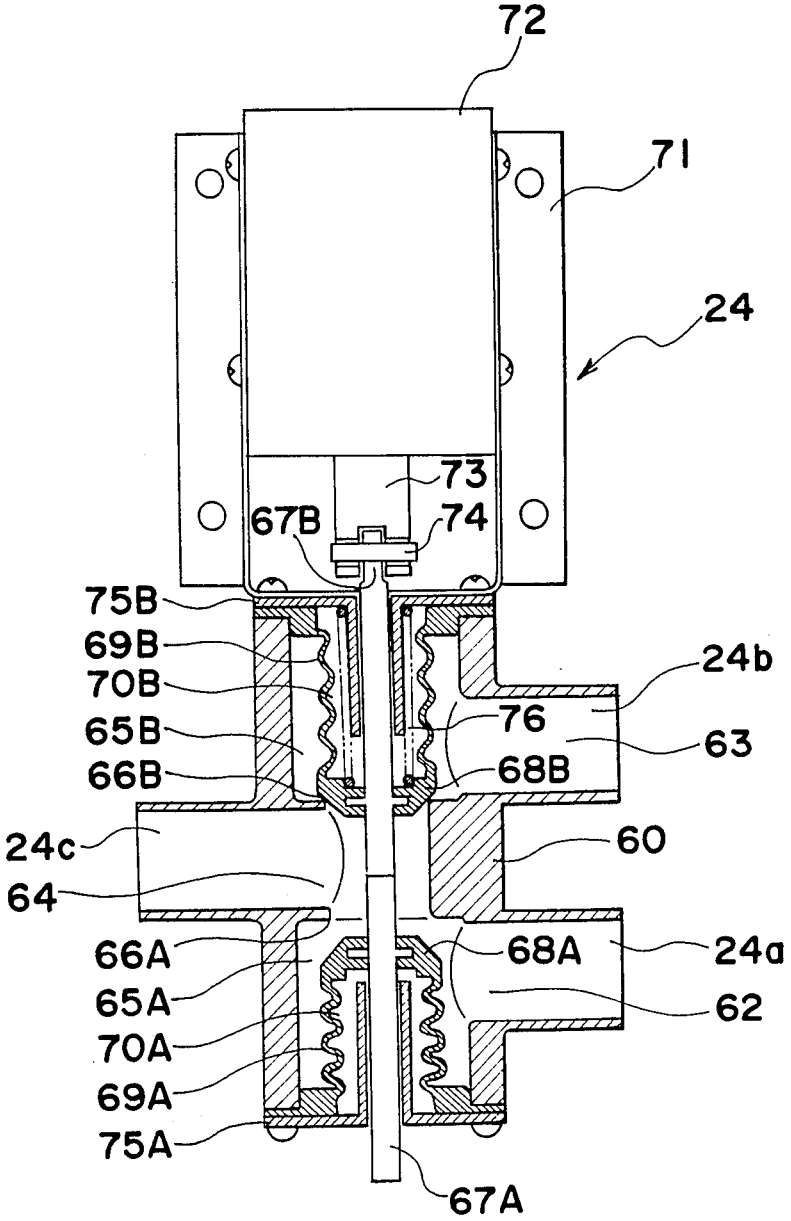
FIG. 6 is a cross-sectional view, on an enlarged scale, of an electromagnetic three-way valve assembly employed in the dishwasher according to the first preferred embodiment of the present invention, said valve assembly being shown in one operative position.
Figure 7:
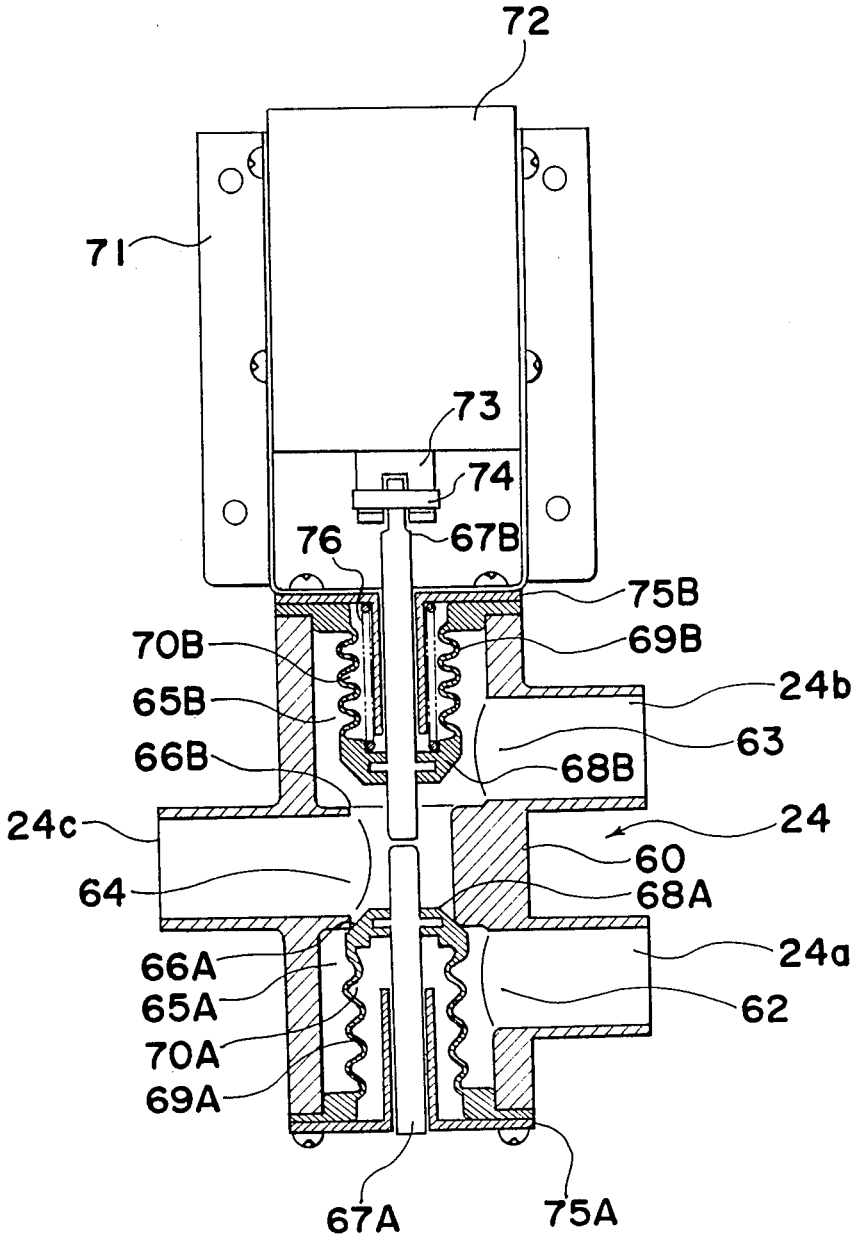
FIG. 7 is a view similar to FIG. 6, showing the valve assembly in an alternative operative position.
Figure 8:
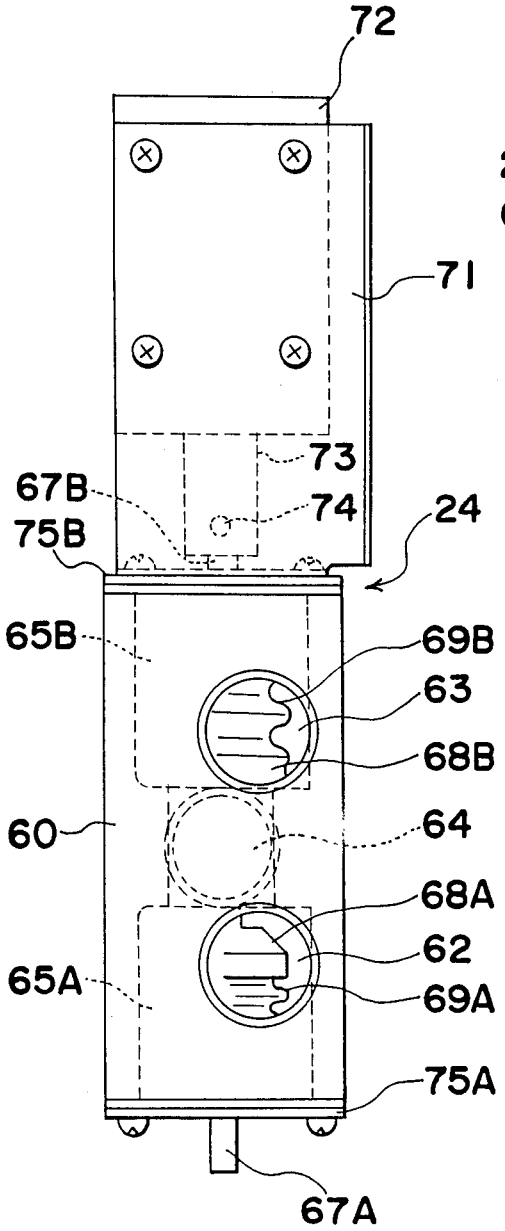
FIG. 8 is an elevational view of the valve assembly shown in FIGS. 6 and 7.

The details of the electromagnetically operated three-way valve assembly 24 utilized for switching over between the washing operation and the rinsing operation are shown in FIGS. 6 to 8, reference to which will now be made.

The valve assembly 24 comprises a valve body 60 having inflow passages 62 and 63, defining the respective intake ports **24*a* and 24*b*, and an outflow passage 64 defining the outlet port 24*c*, and also having a pair of valve chambers 65A and 65B defined therein. Valve chamber 65A is adapted to communicate inflow passage 62 with outflow passage 64. Whereas valve chamber 65B is adapted to communicate inflow passage 63 with outflow passage 64. The valve chamber 65A accommodates therein a valve rod 67A, a valve member 68A rigidly mounted on an inner end of the valve rod 67A, and a flexible bellows 69A mounted around the valve rod 67A whereas the valve chamber 65B accommodates therein a valve rod 67B, a valve member 68B rigidly mounted on an inner end of the valve rod 67B, and a flexible bellows 69B mounted around the valve rod 67B. The valve body 60 is provided with centrally perforated end covers 75A and 75B closing the respective openings of the valve chambers 65A and 65B** to avoid any fluid leakage.

So far shown in FIGS. 6 to 8, the inflow passages 62 and 63 extend in parallel to each other while the outflow passage 64 extends in parallel to and intermediately between the inflow passages 62 and 63 with valve seats 66A and 66B defined in a wall of an inner end of the outflow passage 64 in opposed relation to each other. Any one of the valve chambers 65A and 65B extends perpendicular to the outflow passage 64 and is communicated therewith through the associated valve seat 66A or 66B.

The wall portions of the valve body 60 defining the respective valve chambers 65A and 65B have respective openings defined therein, through which openings the inflow passages 62 and 63 are communicated with the valve chambers 65A and 65B, respectively.

The valve rods 67A and 67B are accommodated in valve chambers 65A and 65B in axially aligned relationship and held in end-to-end abutment, while axially slidingly supported by the respective end covers 75A and 75B. The valve members 68A and 68B each made of elastic heat-resistant material are tightly mounted on respective flanges, formed on the associated valve rods 67A and 67B at a location spaced a certain distance inwardly of the inner ends thereof, by the use of a vulcanization bonding technique. It will readily be understood that the valve members 68A and 68B can be seated against the valve seats 66A and 66B one at a time when the valve rods 67A and 67B are moved downward and upwards, respectively, thereby interrupting the communication between the inflow passages 62 and 63 and the outflow passage 64. In practice, the valve members 68A and 68B are alternately seated against the associated valve seats 66A and 66B by the reason which will become clear from the subsequent description.

The bellows 69A and 69B mounted coaxially on the respective valve rods 67A and 67B are clamped at one end firmly between the end covers 75A and 75B and the opposite ends of the valve body 60 and fluid-tightly secured at the other end to the associated valve members 68A and 68B, with the interiors 70A and 70B of the respective bellows 69A and 69B consequently isolated from the valve chambers 65A and 65B. It is to be noted that, although in the illustrated embodiment the valve members 68A and 68B and the bellows 69A and 69B have been described as constituted by members separate from each other, they may be of one-piece construction.

One of the valve rods, that is, the valve rod 67B has its outer end axially connected by a connecting pin 74 with a solenoid plunger 73 so that, when the solenoid 72 is energized to retract the plunger 73, the valve rod 67B can be pulled in a first direction towards solenoid 72 with the valve member 68B consequently separating away from the valve seat 66B. Unless the solenoid 72 is energized, the valve rod 67B is forcibly urged in a second direction with the valve member 68B seated against the valve seat 66B by a compression spring 76 mounted around the valve rod 67B within the interior 70B of the bellows 69B.

It is to be noted that the valve rod 67A can, then the valve rod 67B is moved against the spring 76 in the first direction as a result of the retraction of the plunger 73, be moved in pursuit of the valve rod 67B by the elasticity of the bellows 69A with the valve member 68A consequently seated against the valve seat 66A. When the valve rod 67B is moved in the second direction urged by the spring 76 during the deenergization of the solenoid 72, the valve rod 67A can be moved against the bellows 69A in contact with the valve rod 67B. If desired, a compression spring similar to the spring 76 may be mounted around the valve rod 67A within the interior of the bellows 69A.

As hereinbefore described with particular reference to FIG. 3, the three-way valve assembly 24 of the above described construction is installed in the dishwasher with the ports **24*a*, 24*b* and 24*c* communicated respectively with the solution tank 12, the hot water storage tank 13 and the suction port of the pump 27. The valve assembly 24** so constructed and so installed operates in the following manner.

During the washing operation, the solenoid 72 is not energized. At this time, the valve assembly 24 is conditioned as shown in FIG. 6. In the condition shown in FIG. 6, by the action of the spring 76, the valve rod 67B is urged in the second direction with the valve member 68B consequently seated against the valve seat 66B. At the same time, the valve rod 67A is moved by the valve rod 67B in a direction conforming to the direction of movement of the valve rod 67B with the valve member 68A consequently separated away from the valve seat 66A. Accordingly, in the condition shown in FIG. 6, that is, during the washing operation, the washing solution within the solution tank 12 flows into the valve chamber 66A through the inflow passage 62 and then emerges outwards from the outflow passage 64 and towards the pump 27 as hereinbefore described.

If the openings of the respective valve seats 66A and 66B are selected to be nearly equal to each other and the effective diameter of each of the bellows 69A and 69B is also selected to be substantially equal to the valve seat 66A or 66B, the valve assembly 24 as a whole can be operated without being adversely affected by the suction negative pressure of the pump and, therefore, a small force of attraction of the solenoid suffices for the proper operation of the valve assembly.

Although the interiors 70A and 70B of the respective bellows 69A and 69B have been shown as communicated to the atmosphere, since the both are of about the same size, it does not affect the operation and, therefore, the urging force for urging the valve member 68B against the valve seat 66B can be determined by the force of the spring 76.

On the other hand, during the rinsing operation, the solenoid 72 is energized so as to bring the valve assembly 24 in a condition as shown in FIG. 7. Specifically, when the solenoid 72 is energized, the valve rod 67B is pulled against the spring 76 by the force of attraction of the solenoid which is greater than the force of the spring 76, with the valve member 68B consequently separated away from the valve seat 66B. At the same time, the valve rod 67A is moved by the elasticity of the bellows 69A with the valve member 68A consequently seated against the valve seat 66A. As a result, the flow of the washing solution from the inflow passage 62 to the outflow passage 64 across the valve chamber 65A is interrupted, but the flow of the hot water from the inflow passage 63 to the outflow passage 64 across the valve chamber 65B is established. The washing solution remaining within the outflow passage 64 can readily be carried away from the valve assembly 24 by the incoming rinsing water and, therefore, the switching from the washing solution to the clean rinsing water can readily be achieved.

It is to be noted that, in the valve assembly of the construction shown in FIGS. 6 to 8, a clearance can preferably be formed between the adjacent ends of the respective valve rods 67A and 67B, as best shown in FIG. 7, when the valve rod 67B is pulled by the plunger 73 during the energization of the solenoid 72. The presence of the clearance is advantageous in that any possible formation of an indentation in that portion of the valve member 68A which is repeatedly engaged against the valve seat 66A would not adversely affect the closure of the fluid circuit from the inflow passage 62 to the outflow passage 64. However, the presence of the above described clearance may not be always essential on the practice of the present invention.

Moreover, if as best shown in FIG. 8, the center axis of each of the inflow passages 62 and 63 is rendered to be eccentric relative to the center axis of the associated valve chamber 65A or 65B and is displaced towards the inner wall portion of the associated valve chamber 65A or 65B, the fluid medium flowing into the valve chambers 65A and 65B at different times can be swirled along the inner wall portion prior to the flow into the outflow passage 64. This is particularly advantageous in view of the fact that the food solids can be washed away from the valve chamber by the swirling action of the fluid medium.

The valve assembly 24 of the above described construction may be modified in numerous ways. For example, where the rate of flow of the rinsing water through the valve assembly 24 is desired to be different from, for instance, smaller than, that of the washing solution therethrough, according to the conventional flow configuration for a dishwasher, the valve assembly 24 may be modified as shown in FIGS. 9 and 10.

It is to be noted that, by modifying the diameters of the openings of the respective valve seats 66A and 66B to make them different from each other or by employing pipings of different bore sizes at the inflow side of the valve assembly, it is possible to make the flow rate of the rinsing water through the valve assembly 24 different from that of the washing solution through the same valve assembly 24. However, this contemplated solution is undesirable because the employment of the modified diameters of the openings of the valve seats may result in not only the increased number of types of the electromagnetically operated valve assemblies, but also the unsteady operational characteristic that will adversely affect the quick switching operation and because the employment of the modified bore sizes of the inflow pipings may result in the increased negative pressure present within the chamber in communication with the inflow piping of reduced bore size and may therefore result in the requirement to reinforce the associated bellows. According to the modification shown in FIGS. 9 and 10, the valve assembly 24 is free from the above discussed problems.

Figure 9:
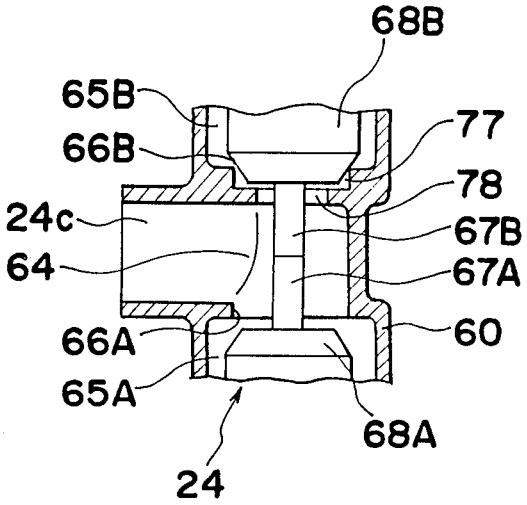
FIGS. 9 and 10 are fragmentary sectional views of an essential portion of the modified three-way valve assembly in different operative positions, respectively.
Figure 10:
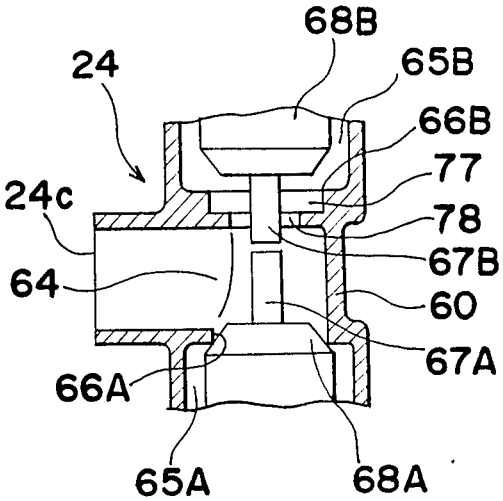

Referring now to FIGS. 9 and 10, the valve assembly 24 modified as shown therein is characterized in that the valve seat 66B is so stepped as to provide a large diameter bore 77, adjacent the valve member 68B, and a reduced diameter bore 78 remote from the valve member 68B so that the opening in the valve seat 66B can act as a throttled passage. It is to be noted that the diameter of the large diameter bore 77 is selected to be equal to that of the opening in confronting valve seat 66A.

According to the modification described with reference to and shown in FIGS. 9 and 10, since the suction negative pressure of the pump acts equally on the valve members 68A and 68B during the washing operation because of the substantially identical sizes of the valve seats 66A and 66B, any possible influence the negative pressure may bring about on the operation can advantageously be eliminated.

On the other hand, during the rinsing operation, the reduced diameter bore 78 provides a resistance to the flow, and accordingly, the flow rate can be reduced. In this case, the pressure drop within the valve chamber 65B is minimized, and the bellows 69B is free from the influence brought about by the negative pressure. Although the negative pressure in the outflow passage 64 may, however, be increased, the force necessary to move the valve member 68B to seat against the associated valve seat need not be increased because of the reduced diameter of the bore 78 defining the throttle passage, and therefore, the force of attraction of the solenoid need not be increased. In addition, since the effective cross-sectional area of the flow passage associated with the valve member 68A is relatively great, it tends to be considerably affected by the negative pressure and the force of contact of the valve member 68A against the valve seat 66A is correspondingly increased thereby to effectively avoid any possible leak of the washing solution from the valve chamber 65A into the outflow passage 64.

Figure 11:
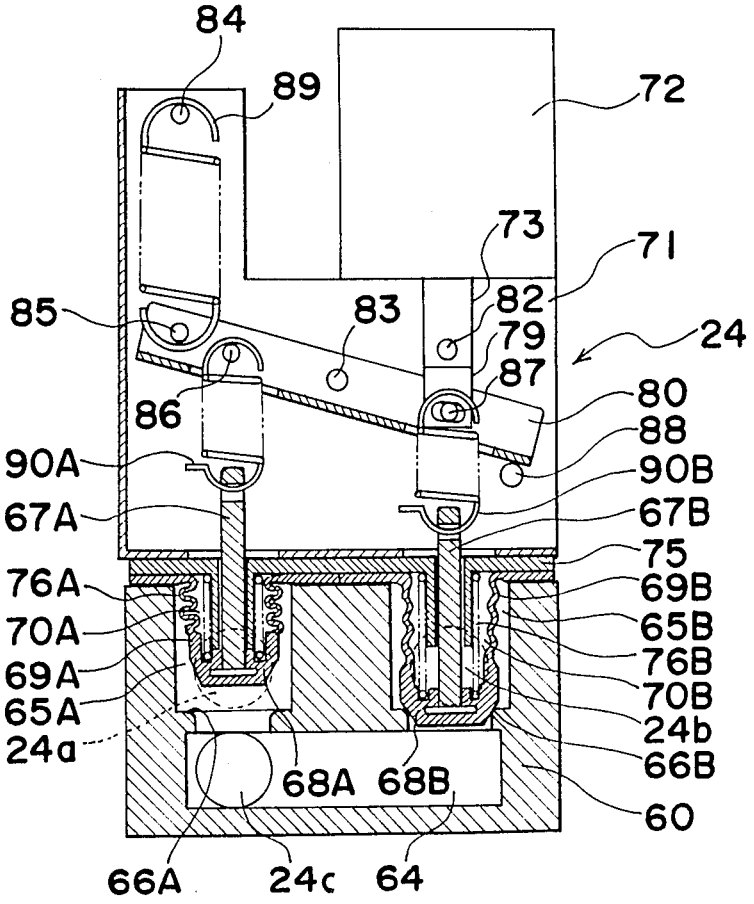
FIG. 11 is a cross-sectional view of the further modified three-way valve assembly utilized in the dishwasher according to the first preferred embodiment of the present invention.

In the modification shown in FIG. 11, the valve rods 67A and 67B with valve members 68A and 68B thereon are arranged in parallel and side-by-side relation to each other so that the valve rod 67A and 67B can be alternatively axially moved in the opposite directions with respect to each other by the solenoid plunger 73 through a rocking lever 80. As shown, the rocking lever 80 is pivotally supported at its substantially intermediate portion by means of a pin 83 and has one end, pivotally coupled with the solenoid plunger 73 through a connecting piece 79, and the other end connected through a tension spring 89 with a pin 84 fixed on a fixture plate 71. Reference numerals 82, 85, 86 and 87 represent respective connecting pins, and reference numeral 88 represents a stopper pin.

The rocking lever 80 is also operatively connected with the valve rods 67A and 67B by means of respective coil springs 90A and 90B arranged in side-by-side relationship and on respective sides of the pivot pin 83.

The valve chambers 65A and 65B accommodating therein the valve rods 67A and 67B, with the valve members 68A and 68B thereon, and biasing springs 76A and 76B, respectively, are formed by boring the valve body 60 from top surface. The outflow passage 64 extends within the valve body 60 in a direction generally perpendicular to the longitudinal sense of any one of the valve chambers 65A and 65B, and the valve seats 66A and 66B are defined in a partition wall in alignment with the valve chambers 65A and 65B, respectively. The biasing springs 76A and 76B act to urge the respective valve members 68A and 68B so as to be seated against the associated valve sets 66A and 66B.

The valve assembly 24 according to the modification described with reference to an shown in FIG. 11 operates in the following manner.

During the washing operation, that is, so long as the solenoid 72 is not energized, the rocking lever 80 is pivoted clockwise, as viewed in FIG. 11, about the pin 83 by the action of the tension spring 89. In this condition, the valve rod 67A is pulled upwards, as viewed in FIG. 11, through the spring 90A with the valve member 68A consequently separated away from the valve seat 66A. On the other hand, since the spring 90B loses its pulling force, the valve rod 67B is moved downwards, as viewed in FIG. 11, by the action of the spring 76B with the valve member 68B consequently seated against the valve seat 66B. Thus, it will readily be seen that only the intake port **24*a* can be communicated with the outlet portion 24*c* to permit the flow of the washing solution through the valve assembly 24** during the washing operation.

When the solenoid 72 is subsequently energized to execute the rinsing operation with the plunger 73 consequently retracted against the spring 89, the lever 80 is pivoted counterclockwise about the pin 83 incident to the retraction of the plunger 73. In this condition, the valve member 68B is separated away from the valve seat 66B while the valve member 68A is seated against the valve seat 66A, thereby establishing the communication between the intake port **24*b* and the outlet port 24*c* to permit the flow of the rinsing water through the valve assembly 24**.

Figure 12:
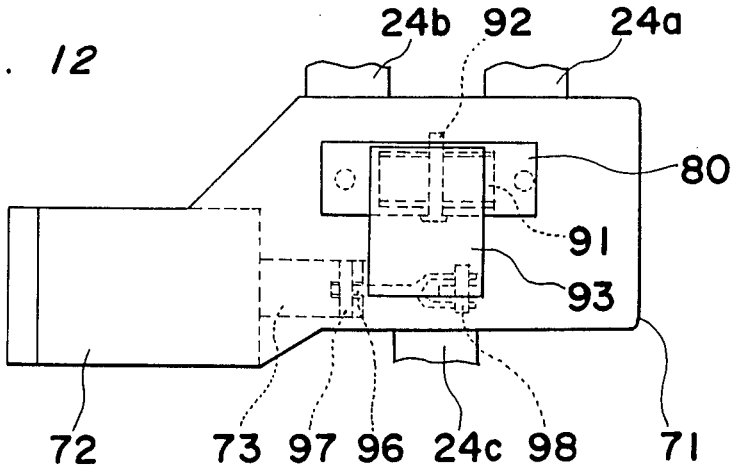
FIGS. 12 and 13 are top and side views, respectively, showing a modified solenoid drive unit utilized in the valve assembly shown in FIG. 11.
Figure 13:
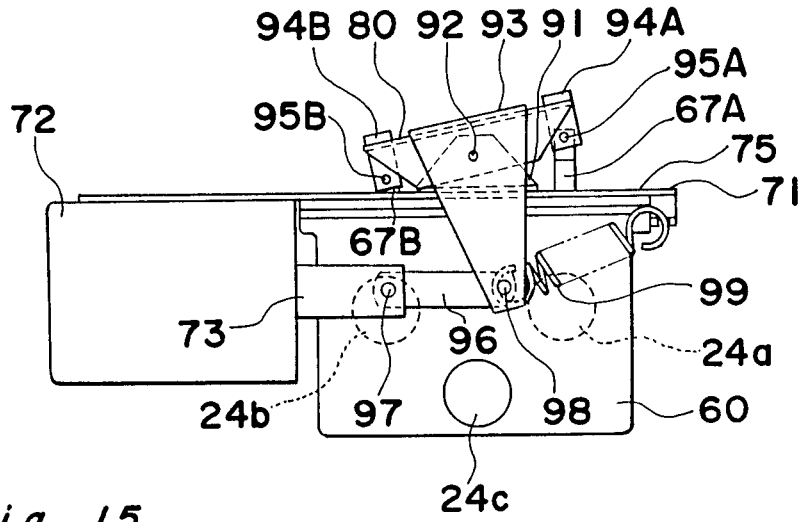

The drive mechanism for alternately driving the valve rods 67A and 67B, employed in the valve assembly shown in FIG. 11, may be modified as shown in FIGS. 12 and 13. Specifically, while the solenoid 72 in the modification shown in FIG. 11 is so arranged and so positioned that the direction of movement of the solenoid plunger 73 may be parallel to the direction of movement of each of the valve rods 67A and 67B, the solenoid 72 in the modification shown in FIGS. 12 and 13 is so arranged and so positioned as to permit the plunger 73 to be movable in a direction generally perpendicular to the direction of movement of any one of the valve rods 67A and 67B.

Referring to FIGS. 11 and 12, the solenoid 72 and the valve body 60 are rigidly mounted on the fixture plate 71. The fixture plate 71 has a support plate 91 rigidly secured thereto on one side thereof opposite to the valve body 60, on which plate 91, an operating plate 93 and the rocking lever 80 are supported for pivotal movement about a pivot pin 92. In the instance as shown, the rocking lever 80 is integrally formed with the operating plate 93, but it may be otherwise rigidly secured thereto.

The rocking lever 80 is connected at its opposite ends with connecting members 94A and 94B which are in turn pivotally connected to the valve rods 67A and 67B by means of connecting pins 95A and 95B, respectively. The solenoid plunger 73 is operatively coupled by a pin 97 with a connecting rod 96 which is in turn connected by a pin 98 with the operating plate 93 so that, when the solenoid plunger 73 is retracted as a result of the energization of the solenoid, the operating plate 93 can be pivoted clockwise, as viewed in FIG. 13, about the pivot pin 92 accompanied by the corresponding clockwise pivot of the rocking lever 80, but when the solenoid plunger 73 projects outwards as a result of the deenergization or the solenoid 72, the operating plate 93 can be pivoted counterclockwise about the pivot pin 92 accompanied by the corresponding counterclockwise pivot of the rocking lever 80. A tension spring 99 interposed between the pin 98, connecting the operating plate 93 with the connecting rod 96, and a portion of the fixture plate 71 acts to pull the solenoid plunger 73 outwardly from the solenoid 72, and therefore, the solenoid plunger 73 is held in a projected position unless the solenoid 72 is energized.

In this construction, it will readily be seen that when the solenoid 72 is energized during the rinsing operation, the intake port **24*b* can be communicated with the outlet portion 24*c*, but when and so long as the solenoid 72 is not energized, the intake portion 24*a* can be communicated with the outlet port 24*c*, in a manner similar to that described with reference to FIG. 11**.

Figure 15:
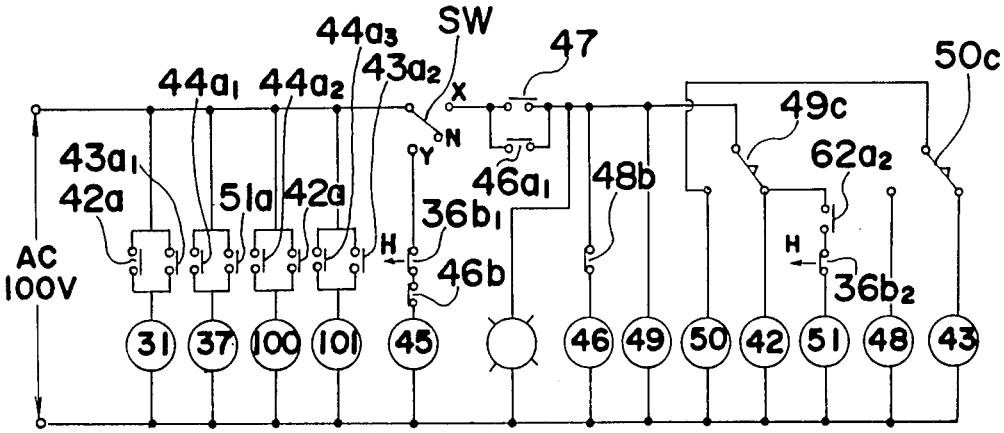
FIGS. 15 and 16 are diagrams similar to FIGS. 4 and 5, respectively, showing the electric control circuit and the timing chart for the dishwasher shown in FIG. 14.
Figures 14, 16:
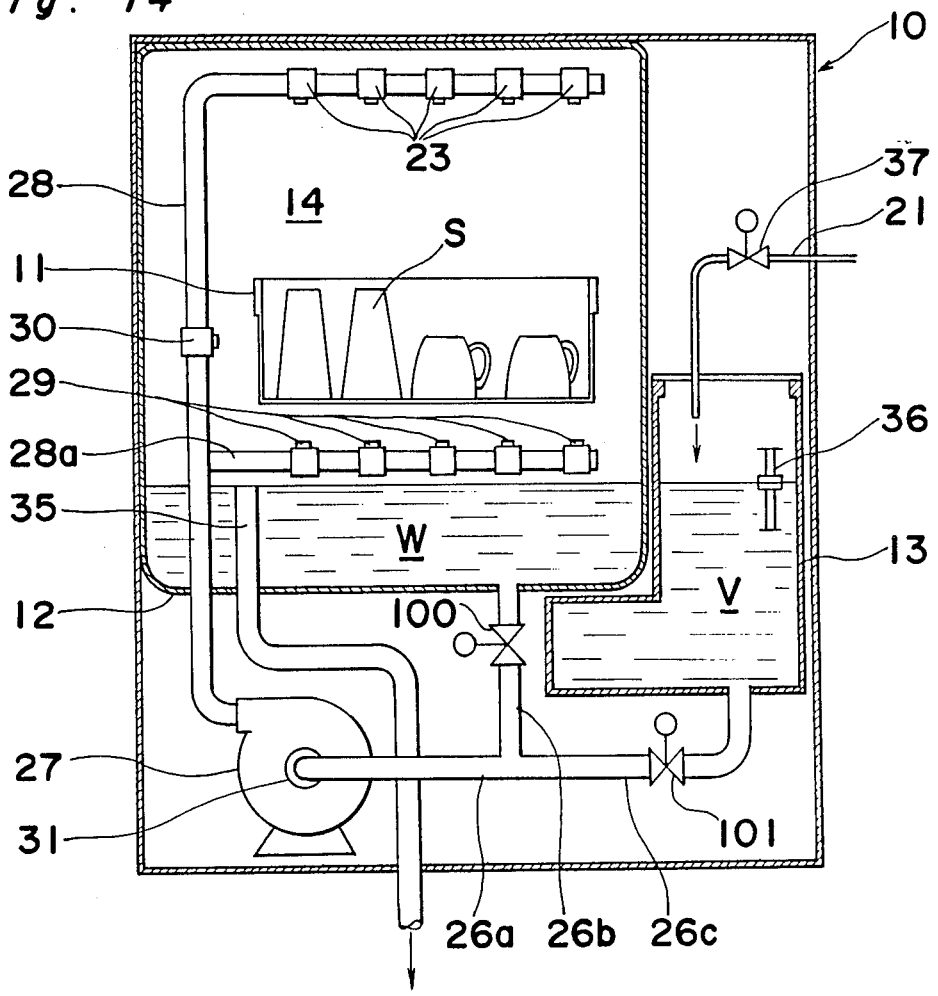
FIG. 14 is a view similar to FIG. 3, showing the dishwasher according to a second preferred embodiment of the present invention.

In FIGS. 14 to 16, there is shown the dishwasher according to another preferred embodiment of the present invention. The dishwasher shown in FIG. 14 differs in structure from that shown in FIG. 4 in that the bottom of the solution tank 12 shown in FIG. 14 is flat, and, also, instead of the single electromagnetically operated three-way valve assembly 24 shown in FIG. 4, separate electromagnetic shut-off valves 100 and 101 are employed respectively for the solution tank 12 and the hot water storage tank 13 shown in FIG. 14.

Referring particularly to FIG. 14, a suction pipe **26*a* having one end fluid-connected with the suction port of the pump 27 has its other end branched into two branch pipes 26*b* and 26*c*. The branch pipe 26*b* is in turn communicated with the bottom of the solution tank 12 through the electromagnetic shut-off valve 100, whereas the branch pipe 26*c* is in turn communicated with the bottom of the hot water storage tank 13 through the electromagnetic shut-off valve 101**.

In addition, the level detector 36 operatively associated with the electromagnetic shut-off valve 37 on the hot water supply pipe 21 is, in the embodiment shown in FIGS. 14 to 16, preferably so designed as to generate a control signal indicative of the full condition of the tank 13 when the top surface of the hot water supplied into the tank 13 attains a predetermined level a few millimeters lower than the level for the solution tank 12 at which the washing solution W starts overflowing into the overflow pipe 35. With this design, variations in design of the level detector 36 can be advantageously compensated for to ensure the exact and reliable operation of the shut-off valve 37 in response to the control signal to interrupt the supply of the hot water into the tank 13.

The operation of the dishwasher according to the second mentioned embodiment of the present invention is substantially similar to that of the foregoing embodiment. More specifically, when the dishwasher according to the second mentioned embodiment is to be used for the first time on a certain day of the month while both of the tanks 12 and 13 are empty, the initial hot water supply has to be carried out. As shown in FIG. 16, this initial hot water supply can be carried out by opening both of the shut-off valves 100 and 101 to communicate the hot water storage tank 13 with the solution tank 12 through the pipes **26*c* and 26*b* while the pump 27 is held inoperative, and then opening the shut-off valve 37 to effect the supply of the hot water into the tank 13**.

As the hot water is poured into the tank 13, the hot water so supplied flows into the pipe **26*c* and then into the tank 12 through the pipe 26*b* because of the simultaneous opening of the electromagnetic shut-off valves 100 and 101. Shortly before the top surface of the water within the solution tank 12 arrives at the predetermined level at which it starts overflowing into the overflow pipe 35, the storage tank 13 becomes full of the hot water with the level detector 36 consequently activated to issue the control signal necessary to close the electromagnetic shut-off valve 37**, thereby interrupting the supply of the hot water.

Referring now to FIG. 15 in combination with FIG. 16, the simultaneous opening of the electromagnetic shut-off valves 37, 100 and 101 can be achieved when a movable contact of a selector switch SW having three switch positions X, N and Y is engaged to the switch position Y to energize both of the shut-off valves 37, 100 and 101. These shut-off valves 37, 100 and 101 can be deenergized to close when the hot water within the storage tank 13 attains the predetermined level at which the level detector 36 generates the control signal.

The subsequent manipulation of the selector switch SW to engage the movable contact to the switch position X causes the shut-off valve 100 to open for a predetermined time set by the timer 49 and, at the same time, causes the motor 31 to drive the pump 27 to effect the washing operation. After the washing operation, the shut-off valve 100 is deenergized to close and the shut-off valve 101 is energized to open, thereby initiating the rinsing operation. This rinsing operation is performed for a predetermined time set by the timer 50. Upon the passage of the predetermined time set by the timer 50, the relay 48 is operated to deenergized the motor 31 for the pump 27 and to deenergize the shut-off valve 101 to close, thereby completing a cycle of the washing and rinsing operations.

Since the rinsing water has been consumed with the tank 13 empty as a result of the performance of the above described cycle, the relay 51 is energized subsequent to the start of the next succeeding cycle, thereby effecting the supply of the hot water into the storage tank 13 until the washing operation completes, in readiness for the subsequent rinsing operation.

Although the present invention has fully been described in connection with the preferred embodiments thereof with reference to the accompanying drawings, it is to be noted that numerous changes and modifications are apparent to those skilled in the art. By way of example, although the shut-off valves 37, 100 and 101 have been described as electromagnetically operated, they may be manually operated shut-off valves.

In addition, although the hot water has been described as supplied into the solution tank 12 from the tank 13 by way of the pipes **26*c* and 26*b* during the initial hot water supply, it is possible to employ a separate hot water supply pipe for supplying the hot water directly into the solution tank 12. In this case, the shut-off valves 100 and 101** need not be opened simultaneously during the initial hot water supply.

Such changes and modifications are to be understood as included within the true scope of the present invention as defined by the appended claims, unless they depart therefrom.

What is claimed is:

1. A dishwasher comprising:

an enclosure for accommodating articles to be washed;

a washing solution tank arranged below the enclosure;

a hot water storage tank for containing a predetermined amount of hot water;

a plurality of nozzle means for spraying a liquid medium towards articles accommodated in the enclosure;

a circulating pump having both a suction and discharge port;

an electric motor for driving said circulating pump;

a first piping means connecting said discharge port of the circulating pump with said plurality of nozzle means;

a second piping means operatively connecting both said washing solution and hot water storage tanks with said suction port of the circulating pump;

a control valve means disposed on the second piping means and operable for closing a first passage between the suction port and the hot water storage tank and opening a second passage between the suction port and the washing solution tank during a washing operation in which articles are washed and for opening and closing said first and second passages, respectively, during a rinsing operation in which articles are rinsed;

a water supply pipe operatively connected with said hot water storage tank;

a shut-off valve disposed on said water supply pipe;

a first level detector operatively connected to said hot water storage tank for detecting the level of water within said hot water storage tank and for generating a signal for closing said shut-off valve when the water within the hot water storage tank attains a predetermined level;

a second level detector operatively connected to said washing solution tank for detecting the level of liquid medium within the washing solution tank;

a water supply control circuit including a water supply start switch, for initiating a hot water supply, and a first operating circuit;

an actuating means operatively associated with said first level detector for selectively opening and closing said shut-off valve in response to said signal;

a hot water supply means for establishing fluid communication between the hot water supply tank and said washing solution tank by controlling said control valve means and said circulating pump for effecting the supply of hot water into said washing solution tank; and a hot water supply interrupting means operable in response to a signal from said second level detector, indicative of the arrival of water within the washing solution tank to a predetermined level, for interrupting the operation of either said actuating means or said hot water supply means;

said first operating circuit being operable to actuate said actuating means, said hot water supply means and said hot water supply interrupting means when the water supply start switch is turned on.

2. A dishwasher as claimed in claim 1, wherein the enclosure comprises a perforated rack of generally cylindrical container-like configuration and wherein the nozzle means comprises an upper group of nozzles positioned above the perforated rack and a lower group of nozzles positioned beneath the perforated rack.

3. A dishwasher as claimed in claim 1, wherein the drive motor for the pump is a speed variable motor having high and low speed drives, and further comprising a control means for driving said motor at the high speed during the washing operation, but at the low speed during the rinsing operation.

4. A dishwasher as claimed in claim 1, further comprising an overflow pipe extending into the solution tank and terminating within the solution tank at a predetermined height above the bottom of the solution tank, and wherein the storage tank is arranged with its bottom positioned above the height at which the overflow pipe terminates.

5. A dishwasher as claimed in claim 1, wherein the control valve means is an electrically operated three-way valve assembly comprising first and second intake ports, an outlet port, a valve switching means for selectively communicating the outlet port with one of the first and second intake ports, and a drive means for electrically driving the valve switching means, and the second piping means has a junction, the three-way valve assembly being disposed at the junction.

6. A dishwasher as claimed in claim 5, wherein the three-way valve assembly is an electromagnetic three-way valve assembly and the drive means electromagnetically drives the valve switching means.

7. A dishwasher as claimed in claim 1, wherein the water supply control circuit further includes means for avoiding an idle run of the pump for initiating the operation of the hot water supply means in response to a first signal from the first level detector and a repeated hot water supply means for counting the operation of the hot water supply means and for, when a predetermined time has passed, interrupting the operation of the hot water supply means until the first level detector generates the next succeeding signal.

8. A dishwasher as claimed in claim 1, further comprising a washing and rinsing operation control circuit for the washing and rinsing operations including a washing and rinsing operation start switch and a second operating circuit, and further comprising a washing timer means operable to establish the communication between the second intake port of the three-way valve assembly, which is in communication with the solution tank, and the outlet port thereof and to count the washing operation for a predetermined time while the circulating pump is driven, a rinsing timer means operable to establish the communication between the first intake port and the outlet port and to count the rinsing operation for a predetermined time subsequent to the time-up of the washing timer means while the circulating pump is driven, a hot water supply selecting means for operating the actuating means during a period in which the washing timer means undergoes its counting operation and for interrupting the operation of the actuating means during a period in which the rinsing timer means undergoes its counting operation, and a washing and rinsing operation interrupting means for interrupting the operation of one of the washing and rinsing timer means when the second level detector generates a signal indicative of the amount of the liquid medium within the solution tank being short of the predetermined level, said second operating circuit being operable to actuate said washing timer means, said rinsing timer means, said hot water supply selecting means and said washing and rinsing operation interrupting means when the washing and rinsing operation start switch is turned on.

* * * * *